US009138864B2

(12) United States Patent
Wendt et al.

(10) Patent No.: US 9,138,864 B2
(45) Date of Patent: Sep. 22, 2015

(54) GREEN COLORED REFRACTORY COATINGS FOR CUTTING TOOLS

(71) Applicant: Kennametal, Inc., Latrobe, PA (US)

(72) Inventors: Karl Heinz Wendt, Ebermannstadt (DE); Volkmar Sottke, Mulheim/Ruhr, DE (US); Rodrigo Alejandro Cooper, Latrobe, PA (US); Peter Leicht, Latrobe, PA (US); Yixiong Liu, Greensburg, PA (US)

(73) Assignee: KENNAMETAL INC., Latrobe, PA (US)

( * ) Notice: Subject to any disclaimer, the term of this patent is extended or adjusted under 35 U.S.C. 154(b) by 62 days.

(21) Appl. No.: 14/163,476

(22) Filed: Jan. 24, 2014

(65) Prior Publication Data

US 2014/0208662 A1 Jul. 31, 2014

Related U.S. Application Data

(63) Continuation-in-part of application No. 13/750,252, filed on Jan. 25, 2013, now Pat. No. 9,017,809.

(51) Int. Cl.
*C23C 16/00* (2006.01)
*B24D 3/06* (2006.01)

(52) U.S. Cl.
CPC ..... *B24D 3/06* (2013.01)

(58) Field of Classification Search
USPC ..... 51/307, 309; 428/698, 699, 701, 702, 428/704
See application file for complete search history.

(56) References Cited

U.S. PATENT DOCUMENTS

| | | | |
|---|---|---|---|
| RE32,111 | E | 4/1986 | Lambert et al. |
| 4,587,174 | A | 5/1986 | Yoshimura et al. |
| 4,707,384 | A | 11/1987 | Schachner et al. |
| 4,714,660 | A | 12/1987 | Gates |
| 4,746,563 | A | 5/1988 | Nakano et al. |
| 4,749,630 | A | 6/1988 | Konig et al. |
| 4,943,450 | A | 7/1990 | Sarin |
| 4,950,558 | A | 8/1990 | Sarin |
| 5,071,696 | A | 12/1991 | Chatfield et al. |
| 5,075,265 | A | 12/1991 | Narula |

(Continued)

FOREIGN PATENT DOCUMENTS

| | | |
|---|---|---|
| DE | 3751689 D1 | 3/1996 |
| EP | 704880 A2 | 4/1996 |

(Continued)

OTHER PUBLICATIONS

McCauley, James W., Structure and Properties of Aluminum Nitride and AION Ceramics, Army Research Laboratory, ARL-TRL-2740, May 2002, pp. i-viii and 1-20.

(Continued)

*Primary Examiner* — Archene Turner
(74) *Attorney, Agent, or Firm* — Matthew Gordon

(57) ABSTRACT

In one aspect, coated cutting tools are described herein. A coated cutting tool described herein comprises a substrate and a coating adhered to the substrate, the coating comprising at least one composite layer deposited by chemical vapor deposition, the composite layer comprising an aluminum oxynitride phase, a metal oxide phase including zirconium oxide, a zirconium sulfur nitride phase and a metal oxynitride phase in addition to the aluminum oxynitride phase, the metal oxynitride phase comprising zirconium oxynitride.

35 Claims, 4 Drawing Sheets

(56) References Cited

U.S. PATENT DOCUMENTS

| | | | |
|---|---|---|---|
| 5,494,743 | A | 2/1996 | Woodard et al. |
| 5,500,279 | A | 3/1996 | Walter et al. |
| 5,618,626 | A | 4/1997 | Nagashima et al. |
| 5,665,431 | A | 9/1997 | Narasimhan |
| 5,709,907 | A | 1/1998 | Battaglia et al. |
| 5,722,803 | A | 3/1998 | Battaglia et al. |
| 5,750,267 | A | 5/1998 | Takase et al. |
| 5,827,570 | A | 10/1998 | Russell |
| 6,007,908 | A | 12/1999 | Reece et al. |
| 6,010,283 | A | 1/2000 | Henrich et al. |
| 6,022,174 | A | 2/2000 | Husvik et al. |
| 6,156,383 | A | 12/2000 | Ishii et al. |
| 6,161,990 | A | 12/2000 | Oles et al. |
| 6,183,846 | B1 | 2/2001 | Moriguchi et al. |
| 6,254,984 | B1 | 7/2001 | Iyori |
| 6,426,137 | B1 | 7/2002 | Oshika et al. |
| 6,528,180 | B1 | 3/2003 | Lee et al. |
| 6,652,922 | B1 | 11/2003 | Forester et al. |
| 6,811,880 | B1 | 11/2004 | Clough |
| 6,811,881 | B1 | 11/2004 | Clough |
| 6,835,446 | B2 | 12/2004 | Ueda et al. |
| 6,838,179 | B1 | 1/2005 | Legrand |
| 6,924,037 | B1 | 8/2005 | Joret et al. |
| 6,933,065 | B2 | 8/2005 | Arendt et al. |
| 7,005,189 | B1 | 2/2006 | Tachibana et al. |
| 7,087,295 | B2 | 8/2006 | Okada et al. |
| 7,244,520 | B2 | 7/2007 | Kumakura et al. |
| 7,258,927 | B2 | 8/2007 | Foltyn et al. |
| 7,322,776 | B2 | 1/2008 | Webb et al. |
| 7,410,707 | B2 | 8/2008 | Fukui et al. |
| 7,531,213 | B2 | 5/2009 | Bjormander |
| 7,541,102 | B2 | 6/2009 | Klippe et al. |
| 7,544,410 | B2 | 6/2009 | Lengauer et al. |
| 7,592,077 | B2 | 9/2009 | Gates, Jr. et al. |
| 7,608,335 | B2 | 10/2009 | Findikoglu et al. |
| 7,659,002 | B2 | 2/2010 | Coster et al. |
| 7,704,611 | B2 | 4/2010 | Coddet et al. |
| 7,727,934 | B2 | 6/2010 | Foltyn et al. |
| 7,736,728 | B2 | 6/2010 | Loboda et al. |
| 7,745,009 | B2 | 6/2010 | Decroupet et al. |
| 7,758,950 | B2 | 7/2010 | Moriguchi et al. |
| 7,782,569 | B2 | 8/2010 | Cheng et al. |
| 7,785,700 | B2 | 8/2010 | Okada et al. |
| 7,829,194 | B2 | 11/2010 | Brady et al. |
| 7,972,684 | B2 | 7/2011 | Hara et al. |
| 7,981,516 | B2 | 7/2011 | Labrousse et al. |
| 8,003,231 | B2 | 8/2011 | Yamamoto |
| 8,017,244 | B2 | 9/2011 | Hevesi |
| 8,080,323 | B2 | 12/2011 | Ban et al. |
| 8,119,226 | B2 | 2/2012 | Reineck et al. |
| 8,192,793 | B2 | 6/2012 | Sandberg et al. |
| 8,247,080 | B2 | 8/2012 | Iacovangelo et al. |
| 2003/0044652 | A1 | 3/2003 | Wang |
| 2003/0134039 | A1 | 7/2003 | Ross et al. |
| 2003/0175557 | A1 | 9/2003 | Anderson et al. |
| 2004/0076764 | A1 | 4/2004 | Forester et al. |
| 2004/0209126 | A1 | 10/2004 | Ziegler et al. |
| 2005/0008883 | A1 | 1/2005 | Takagi et al. |
| 2005/0025973 | A1 | 2/2005 | Slutz et al. |
| 2005/0064247 | A1 | 3/2005 | Sane et al. |
| 2006/0008676 | A1 | 1/2006 | Ebata et al. |
| 2006/0019118 | A1 | 1/2006 | Gates, Jr. et al. |
| 2006/0093758 | A1 | 5/2006 | Sakakura et al. |
| 2006/0127699 | A1 | 6/2006 | Moelle et al. |
| 2006/0159912 | A1 | 7/2006 | Haldeman |
| 2006/0182991 | A1 | 8/2006 | Tauchi et al. |
| 2006/0204772 | A1 | 9/2006 | Mukunoki et al. |
| 2006/0234064 | A1 | 10/2006 | Baubet et al. |
| 2006/0240266 | A1 | 10/2006 | Schicht et al. |
| 2007/0030569 | A1 | 2/2007 | Lu et al. |
| 2007/0172696 | A1 | 7/2007 | Tong et al. |
| 2008/0118762 | A1 | 5/2008 | Morimoto et al. |
| 2010/0062245 | A1 | 3/2010 | Martin et al. |
| 2010/0132762 | A1 | 6/2010 | Graham, Jr. et al. |
| 2010/0242265 | A1 | 9/2010 | Wadley et al. |
| 2010/0247930 | A1 | 9/2010 | Zurbuchen |
| 2010/0255337 | A1 | 10/2010 | Langhorn |
| 2011/0016946 | A1 | 1/2011 | Brahmandam et al. |
| 2011/0102968 | A1 | 5/2011 | Choi et al. |
| 2011/0151173 | A1 | 6/2011 | Ramadas et al. |
| 2012/0144965 | A1 | 6/2012 | Engstrom |
| 2012/0207948 | A1 | 8/2012 | Lee |
| 2012/0237794 | A1 | 9/2012 | Sottke et al. |
| 2012/0258294 | A1 | 10/2012 | Leyder et al. |
| 2012/0258295 | A1 | 10/2012 | Leyder et al. |

FOREIGN PATENT DOCUMENTS

| | | | |
|---|---|---|---|
| EP | 784101 | B1 | 8/1999 |
| EP | 732423 | B1 | 6/2001 |
| EP | 1724811 | A2 | 11/2006 |
| EP | 1247789 | B1 | 4/2008 |
| EP | 1705263 | B1 | 12/2009 |
| GB | 2 038 370 | A | 7/1980 |
| WO | 2005118505 | A1 | 12/2005 |
| WO | 2006005067 | A2 | 1/2006 |
| WO | 2006007728 | A1 | 1/2006 |
| WO | 2007001337 | A2 | 1/2007 |
| WO | 2007005925 | A1 | 1/2007 |
| WO | 2007018974 | A2 | 2/2007 |

OTHER PUBLICATIONS

May 1, 2014—PCT_Search_Report_and_Written_Opinion.

Martensson, Per, "Influence of the concentration of ZrCl4 on texture, morphology and growth rate of CVD grown α-Al2O3 coatings deposited by the AlCl3/ZrCl4/H2/CO2/H2S process", Mar. 15, 2006.

Moltrecht, Machine Shop Practice, International Press Inc., New York, New York (1981) pp. 199-204.

Aste, Tool Engineers Handbook, McGraw Hill Book Co, New York, New York (1949) pp. 302-315.

GREEN COLORED REFRACTORY COATINGS FOR CUTTING TOOLS

RELATED APPLICATION DATA

The present application is a continuation-in-part under 35 U.S.C. §120 of U.S. patent application Ser. No. 13/750,252 filed Jan. 25, 2013, which is incorporated herein by reference in its entirety.

FIELD

The present invention relates to refractory coatings for cutting tools and, in particular, to coatings deposited by chemical vapor deposition (CVD) having a green color.

BACKGROUND

Cutting tools, including cemented carbide cutting tools, have been used in both coated and uncoated conditions for machining various metals and alloys. In order to increase cutting tool wear resistance, performance and lifetime, one or more layers of refractory material have been applied to cutting tool surfaces, TiC, TiCN, TiN and/or $Al_2O_3$, for example, have been applied to cemented carbide substrates by CVD and by physical vapor deposition (PVD). While effective in inhibiting wear and extending tool lifetime in a variety of applications, refractory coatings based on single or multilayer constructions of the foregoing refractory materials have increasingly reached their performance limits, thereby calling for the development of new coating architectures for cutting tools.

SUMMARY

In one aspect, cutting tools are described having coatings adhered thereto which, in some embodiments, can demonstrate desirable wear resistance and increased cutting lifetimes. A coated cutting tool described herein comprises a substrate and a coating adhered to the substrate, the coating comprising at least one composite layer deposited by chemical vapor deposition, the composite layer comprising an aluminum oxynitride phase, a metal oxide phase including zirconium oxide and a metal oxynitride phase in addition to the aluminum oxynitride phase, the metal oxynitride phase comprising zirconium oxynitride. In some embodiments, the metal oxide phase further comprises a metallic element selected from the group consisting of aluminum, hafnium and titanium. When present, the metallic element can form an additional metal oxide and/or a mixed oxide with zirconium. Additionally, the composite layer can further comprise a zirconium sulfur nitride phase.

In alternative embodiments, a composite layer deposited by chemical vapor deposition comprises an aluminum oxynitride phase, a metal oxide phase including zirconium oxide and a zirconium sulfur nitride phase. The composite layer of the coating, in some embodiments, further comprises a metal oxynitride phase in addition to the aluminum oxynitride phase, the metal oxynitride phase comprising zirconium oxynitride. Moreover, the metal oxide phase can further comprise a metallic element selected from the group consisting of aluminum, hafnium and titanium. When present, the metallic element can form an additional metal oxide and/or a mixed oxide with zirconium.

A composite layer described herein, in some embodiments, exhibits a color in the wavelength range of 490 nm to 580 nm Further, the coating adhered to the substrate can have a critical load ($L_c$) of at least 60 N.

Methods of making coated cutting tools are also described herein. A method of making a coated cutting tool comprises providing a substrate and depositing over the substrate by chemical vapor deposition at least one composite layer of a coating, the composite layer comprising an aluminum oxynitride phase, a metal oxide phase including zirconium oxide and a metal oxynitride phase in addition to the aluminum oxynitride phase, the metal oxynitride phase comprising zirconium oxynitride. As described herein, the deposited composite layer can further comprise a zirconium sulfur nitride phase. Additionally, the metal oxide phase of the deposited composite layer can further comprise a metallic element selected from the group consisting of aluminum, hafnium and titanium. When present the metallic element can form an additional metal oxide and/or a mixed oxide with zirconium.

The composite layer, in some embodiments, is deposited from a gaseous mixture comprising an aluminum source, oxygen source, nitrogen source and zirconium source. As described further herein, the gaseous deposition mixture can also comprise a sulfur source.

In another aspect, a method of making a coated cutting tool comprises providing a substrate and depositing over the substrate by chemical vapor deposition at least one composite layer of a coating, the composite layer comprising an aluminum oxynitride phase, a metal oxide phase including zirconium oxide and a zirconium sulfur nitride phase. The composite layer, in some embodiments, is deposited from a gaseous mixture comprising an aluminum source, oxygen source, nitrogen source, zirconium source and sulfur source.

These and other embodiments are described further in the detailed description which follows.

DETAILED DESCRIPTION

Figure 1:
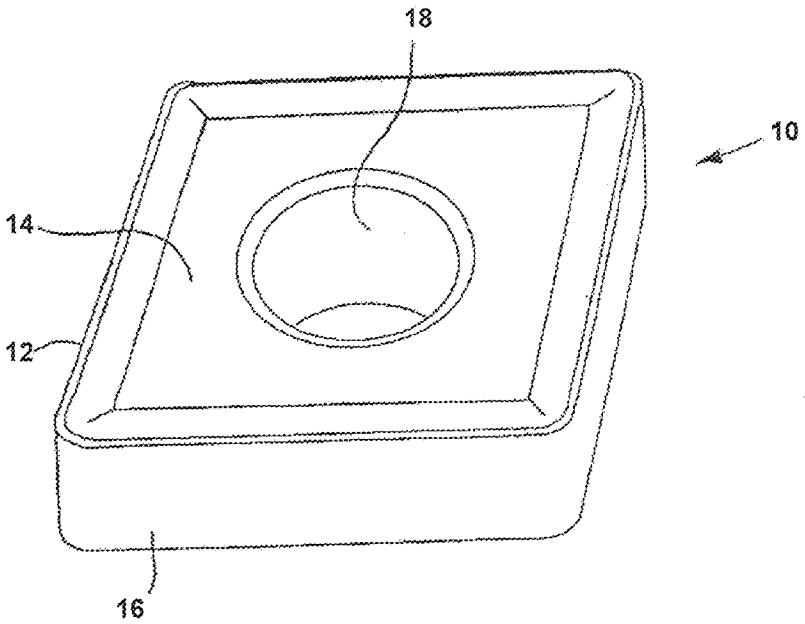
FIG. 1 illustrates a substrate of a coated cutting tool according to one embodiment described herein.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention, Numerous modifications and adaptations will be readily apparent to those of skill in the art without departing from the spirit and scope of the invention.

I. Coated Cutting Tools

In one aspect, cutting tools are described having coatings adhered thereto which, in some embodiments, can demonstrate desirable wear resistance and increased cutting lifetimes. A coated cutting tool described herein comprises a substrate and a coating adhered to the substrate, the coating comprising at least one composite layer deposited by chemical vapor deposition, the composite layer comprising an aluminum oxynitride phase, a metal oxide phase including zirconium oxide and a metal oxynitride phase in addition to the aluminum oxynitride phase, the metal oxynitride phase comprising zirconium oxynitride. In some embodiments, the metal oxide phase further comprises a metallic element selected from the group consisting of aluminum, hafnium and titanium. When present, the metallic element can form an additional metal oxide and/or a mixed oxide with zirconium. Additionally, the composite layer can further comprise a zirconium sulfur nitride phase. Interestingly, a composite layer described herein can exhibit of a color in the wavelength range of 490 nm to 580 nm.

Turning now to specific components, a coated cutting tool described herein comprises a substrate. Substrates of coated cutting tools can comprise any material not inconsistent with the objectives of the present invention. In some embodiments, a substrate comprises cemented carbide, carbide, ceramic, cermet or steel.

A cemented carbide substrate, in some embodiments, comprises tungsten carbide (WC). WC can be present in a substrate in an amount of at least about 70 weight percent. In some embodiments, WC is present in a substrate in an amount of at least about 80 weight percent or in an amount of at least about 85 weight percent. Additionally, metallic binder of a cemented carbide substrate can comprise cobalt or cobalt alloy. Cobalt, for example, can be present in a cemented carbide substrate in an amount ranging from about 3 weight percent to about 15 weight percent. In some embodiments, cobalt is present in a cemented carbide substrate in an amount ranging from about 5 weight percent to about 12 weight percent or from about 6 weight percent to about 10 weight percent. Further, a cemented carbide substrate may exhibit a zone of binder enrichment beginning at and extending inwardly from the surface of the substrate.

A cemented carbide substrate can also comprise one or more additives such as, for example, one or more of the following elements and/or their compounds: titanium, niobium, vanadium, tantalum, chromium, zirconium and/or hafnium. In some embodiments, titanium, niobium, vanadium, tantalum, chromium, zirconium and/or hafnium form solid solution carbides with the WC in the substrate. The substrate, in some embodiments, comprises one or more solid solution carbides in an amount ranging from about 0.1 weight percent to about 5 weight percent. Additionally, a cemented carbide substrate can comprise nitrogen.

In some embodiments, a substrate of a coated cutting tool described herein comprises one or more cutting edges formed at the juncture of a rake face and flank faces of the substrate. FIG. 1 illustrates a substrate of a coated cutting tool according to one embodiment described herein. As illustrated in FIG. 1, the substrate (10) has cutting edges (12) formed at the junction of the substrate rake face (14) and flank faces (16). The substrate also comprises an aperture (18) operable to secure the substrate (10) to a tool holder.

In some embodiments, a substrate of a coated cutting tool is an insert, drill bit, end mill, saw blade or other cutting apparatus.

As described herein, a coating adhered to the substrate comprises at least one composite layer deposited by chemical vapor deposition, the composite layer comprising an aluminum oxynitride (AlON) phase, a metal oxide phase including zirconium oxide and a metal oxynitride phase in addition to the aluminum oxynitride phase comprising zirconium oxynitride. The AlON phase can be present in the composite layer in any amount not inconsistent with the objectives of the present invention. The AlON phase, for example, can be the major phase of the composite layer serving as a matrix for the metal oxide and metal oxynitride phases discussed further herein. In some embodiments, the AlON phase is present in the composite layer in an amount selected from Table I.

TABLE I

| AlON Phase of Composite Layer (Volume Percent)<br>AlON Phase (vol. %) |
|---|
| ≥50 |
| ≥60 |
| ≥70 |
| ≥80 |
| 85-99 |
| 90-99 |

Aluminum, nitrogen and oxygen contents of an AlON phase described herein can be varied according to the CVD parameters selected. Aluminum of the AlON phase, for example, can range from 20 to 50 atomic %. In some embodiments, aluminum of the AlON phase is in the range of 25 to 40 atomic % or 32 to 38 atomic %. Nitrogen of the AlON phase can range from 40 to 70 atomic %, In some embodiments, nitrogen of the AlON phase is in the range of 55 to 70 atomic % or 63 to 67 atomic %. Further, oxygen of the AlON phase can range from 1 to 20 atomic %. In some embodiments, oxygen of the AlON phase is in the range of 2 to 15 atomic % or 4 to 6 atomic %.

The AlON phase can be polycrystalline. For example, the AlON phase can display a hexagonal crystalline structure, cubic crystalline structure or mixture of hexagonal and cubic crystalline structures. Alternatively, the AlON phase is amorphous. Further, the AlON phase can display a mixture of crystalline and amorphous structures, wherein the crystalline structures are hexagonal, cubic or a combination thereof. The AlON phase, in some embodiments, demonstrates a fine grain structure with grains having sizes in the range of 10 nm to 2 μm.

As described herein, the composite layer also comprises a metal oxide phase including zirconium oxide. In some embodiments, the metal oxide phase further comprises a metallic element selected from the group consisting of aluminum, hafnium and titanium. When present, the metallic element can form an additional metal oxide and/or a mixed oxide with zirconium. For example, when the metallic element is aluminum, the metal oxide phase can comprise $Al_2O_3$ and/or AlZrO in addition to zirconium oxide. The metal oxide phase can be a minor phase of the composite layer, being contained or disposed in the AlON matrix. In some embodiments, the metal oxide phase is present in the composite layer in an amount selected from Table II.

TABLE II

| Metal Oxide Phase of Composite Layer (Volume Percent)<br>Metal Oxide Phase (Vol. %) |
|---|
| 1-15 |
| 2-12 |
| 3-10 |

The metal oxide phase can be crystalline. For example, the metal oxide phase can display a cubic crystalline structure, monoclinic crystalline structure, tetragonal crystalline structure, hexagonal crystalline structure or mixtures thereof. The metal oxide phase, in some embodiments, demonstrates a fine grain structure with grains having sizes in the range of 10 nm to 2 μm. Grains of the metal oxide phase, in some embodiments, have a spherical or elliptical geometry.

The composite layer of a coating described herein also comprises a metal oxynitride phase in addition the AlON phase, the metal oxynitride phase comprising zirconium oxide. In some embodiments, the metal oxynitride phase further comprises an oxynitride of a metallic element selected from Group IVB, VB or VIB of the Periodic Table in addition to zirconium oxynitride. For example, titanium oxynitride may be present in addition to zirconium oxynitride. The metal oxynitride phase, in some embodiments, is a minor phase of the composite layer being contained or dispersed in the AlON phase. In some embodiments, for example, the metal oxynitride phase is present in the composite layer in an amount selected from Table III.

TABLE III

| Metal Oxynitride Phase of the Composite Layer (Volume Percent)<br>Metal Oxynitride Phase (Vol. %) |
|---|
| 0-10 |
| 0.5-10 |
| 1-9 |
| 2-8 |

As described herein, the composite layer can also comprise a zirconium sulfur nitride phase. The zirconium sulfur nitride can be a minor phase of the composite layer, being contained or disposed in the AlON matrix phase. In some embodiments, for example, the zirconium sulfur nitride phase is present in the composite layer in an amount selected from Table IV.

TABLE IV

| Zirconium Sulfur Nitride Phase of the Composite Layer (Volume Percent)<br>Zirconium Sulfur Nitride Phase (Vol. %) |
|---|
| 0-20 |
| 0.5-20 |
| 1-15 |
| 2-10 |
| 0.1-5 |

The metal oxide phase, metal oxynitride phase and/or zirconium sulfur nitride phase can be substantially uniformly distributed throughout the AlON matrix phase. Alternatively, the metal oxide phase, metal oxynitride phase and/or zirconium sulfur nitride phase can be heterogeneously distributed in the AlON matrix, thereby producing gradients of one or more of these phases in the composite layer. Further, the metal oxide phase, metal oxynitride phase and/or zirconium sulfur nitride phase can be introduced in the composite layer at differing depths. Careful control of CVD deposition parameters can be used to control the spatial distribution of phases in the composite layer.

Volume percentages of AlON phase, metal oxide phase, metal oxynitride phase and zirconium sulfur nitride phase of a composite layer described herein can be determined using glow discharge optical emission spectroscopy (GDOES) and energy dispersive X-ray spectroscopy (EDX/EDS). In one embodiment, for example, the composition of a coating composite layer described herein can be analyzed by GDOES using GDA750 Glow Discharge Spectrometer (Spectrum Analytic Ltd. of Hof, Germany) with spot diameter of 1.0 mm. The sputtered material removal for analysis can be administered with 0.5 μm steps from the top of the coating to the substrate side. Further, additional analysis of a coating composite layer described herein can be conducted by EDS using scanning electron microscopy equipment LEO 430i (LEO Ltd. of Oberkochen, Germany) with analysis system of LINK ISIS (Oxford Ltd.)

For phase analysis/characterization of coated cutting tools described herein, diffractometer type D5000 (Siemens) with Bragg-Brentano graizing-incidenz system and X-ray Cu Kα with Ni filter (λ 0.01578 nanometers) can be used with operating parameters of 40 KV and 40 MA. In alternative embodiments, a composite layer deposited by chemical vapor deposition comprises an aluminum oxynitride phase, a metal oxide phase including zirconium oxide and a zirconium sulfur nitride phase. As described herein, the composite layer of the coating, in some embodiments, further comprises a metal oxynitride phase in addition to the aluminum oxynitride phase, the metal oxynitride phase comprising zirconium oxynitride. Moreover, the metal oxide phase can further comprise a metallic element selected from the group consisting of aluminum, hafnium and titanium. When present, the metallic element can form an additional metal oxide and/or a mixed oxide with zirconium. For example, when the metallic element is aluminum, the metal oxide phase can comprise $Al_2O_3$ and/or AlZrO in addition to zirconium oxide.

A composite layer of a coating described herein can have any thickness not inconsistent with the objectives of the present invention. In some embodiments, a composite layer has a thickness selected from Table V.

TABLE V

| Composite Layer Thickness (μm)<br>Composite Layer Thickness (μm) |
|---|
| 0.5-15 |
| 1-12 |
| 1.5-10 |
| 3-7 |

Figure 4:
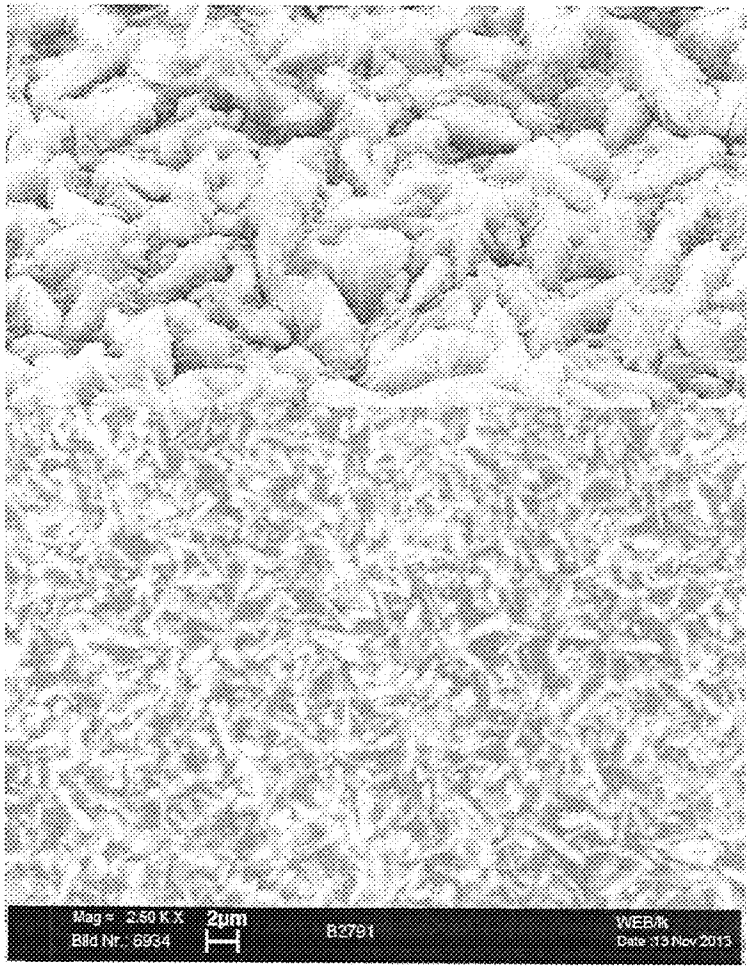
FIG. 4 is a topography and polished surface scanning electron microscope (SEM) image of a composite layer of coated cutting insert according to one embodiment described herein.

Moreover, a composite layer of a coating described herein, in some embodiments, can exhibit a color in the wavelength range of 490 nm to 580 nm. The green color of the composite layer can extend throughout the thickness of the composite layer. In embodiments wherein the composite layer is the outermost layer, the coated cutting tool is provided a distinctive green color. A composite layer can also display acicular or needle-like grains on the surface of the composite layer. The acicular grains can comprise one or more of a metal oxide, metal nitride, metal sulfide or combination thereof, wherein the metal is selected from Group IVB or VB of the Periodic Table. These acicular structures can be subjected to post-coat treatment described further herein to provide a smooth and uniform surface. FIG. 4 is a topography and polished surface SEM image of a composite layer illustrating the acicular or needle-like surface grains.

A composite layer can be deposited directly on the cutting tool substrate surface. Alternatively, a coating described herein can further comprise one or more inner layers between the composite layer and the substrate. One or more inner layers, in some embodiments, comprise one or more metallic elements selected from the group consisting of aluminum and metallic elements of Groups IVB, VB and VIB of the Periodic Table and one or more non-metallic elements selected from the group consisting of non-metallic elements of Groups IIIA, IVA, VA and VIA of the Periodic Table. In some embodiments, one or more inner layers between the substrate and composite layer comprise a carbide, nitride, carbonitride, oxycarbonitride, oxide or boride of one or more metallic elements selected from the group consisting of aluminum and metallic elements of Groups IVB, VB and VIB of the Periodic Table. For example, one or more inner layers can be selected from the group consisting of titanium nitride, titanium carbonitride, titanium carbide, titanium oxide, titanium oxycarbonitride, zirconium oxide, zirconium nitride, zirconium carbonitride, hafnium nitride, hafnium carbonitride and alumina and mixtures thereof.

Inner layers of coatings described herein can have any thickness not inconsistent with the objectives of the present invention. An inner layer of a coating can have a thickness ranging from 0.5 μm to 12 μm. In some embodiments, thickness of an inner layer is selected according to the position of the inner layer in the coating. An inner layer deposited directly on a surface of the substrate as an initial layer of the coating, for example, can have a thickness ranging from 0.5 to 2.5 μm. An inner layer deposited over the initial layer, such as a TiCN layer, can have a thickness ranging from 2 μm to 12 μm. Further, an inner layer on which a composite layer described herein is deposited, such as a layer comprising alumina, can have a thickness ranging from 1 to 6 μm.

In some embodiments, a composite layer described herein is the outermost layer of the coating. Alternatively, a coating described herein can comprise one or more outer layers over the composite layer. One or more outer layers, in some embodiments, comprise one or more metallic elements selected from the group consisting of aluminum and metallic elements of Groups IVB, VB and VIB of the Periodic Table and one or more non-metallic elements selected from the group consisting of non-metallic elements of Groups IIIA, IVA, VA and VIA of the Periodic Table. In some embodiments, one or more outer layers over the composite layer comprise a nitride, carbonitride, oxycarbonitride, oxide or boride of one or more metallic elements selected from the group consisting of aluminum and metallic elements of Groups IVB, VB and VIB of the Periodic Table. For example, one or more outer layers can be selected from the group consisting of titanium nitride, titanium carbonitride, titanium carbide, zirconium nitride, zirconium carbonitride, hafnium nitride, hafnium carbonitride and alumina and mixtures thereof.

Outer layers of coatings described herein can have any thickness not inconsistent with the objectives of the present invention. An outer layer of a coating, in some embodiments, can have a thickness ranging from 0.5 μm to 5 μm.

Additionally, in some embodiments, a coating described herein can comprise one or more bonding layers. A bonding layer can demonstrate various positions in a coating described herein.

In some embodiments, a bonding layer is disposed between two inner layers of the coating, such as between a titanium nitride or titanium carbonitride inner layer and an inner layer comprising alumina. A bonding layer can also be disposed between an inner layer and a composite layer described herein. Further, a bonding layer can be disposed between a composite layer and an outer layer of the coating. In some embodiments, bonding layers are used to increase adhesion between layers of the coating and/or nucleate the desired morphology of a coating layer deposited on the bonding layer. A bonding layer, in some embodiments, is of the formula $M(O_xC_yN_z)$, wherein M is a metal selected from the group consisting of metallic elements of Groups IVB, VB and VIB of the Periodic Table and $x \geq 0$, $y \geq 0$ and $z \geq 0$ wherein $x+y+z=1$. For example, in one embodiment, a bonding layer of TiC is employed between an inner layer of TiCN and an inner layer comprising alumina.

A bonding layer of the formula $M(O_xC_yN_z)$ can have any thickness not inconsistent with the objectives of the present invention. In some embodiments, an $M(O_xC_yN_z)$ layer has a thickness of about 0.5 μm. Moreover, an $M(O_xC_yN_z)$ layer can have a thickness ranging from 0.1 μm to 5 μm.

A coating adhered to a substrate can have any architecture of composite layer, inner layer(s) and/or outer layer(s) described herein. In some embodiments, a coating described herein has an architecture selected from Table VI.

TABLE VI

| Coating Architectures | | |
|---|---|---|
| Inner Layer(s) | Composite Layer | Outer Layer (optional) |
| TiN | AlON/$ZrO_2$/ZrON | ZrN, ZrCN, TiN or $Al_2O_3$ |
| TiN | AlON/$Al_2O_3$/$ZrO_2$/ZrON | ZrN, ZrCN, TiN or $Al_2O_3$ |
| TiN—TiCN(MT)* | AlON/$ZrO_2$/ZrON | ZrN, ZrCN, TiN or $Al_2O_3$ |
| TiN—TiCN(MT) | AlON/$Al_2O_3$/$ZrO_2$/ZrON | ZrN, ZrCN, TiN or $Al_2O_3$ |
| TiN—TiCN(MT)—$Al_2O_3$ | AlON/$ZrO_2$/ZrON | ZrN, ZrCN, TiN or $Al_2O_3$ |
| TiN—TiCN(MT)—$Al_2O_3$ | AlON/$Al_2O_3$/$ZrO_2$/ZrON | ZrN, ZrCN, TiN or $Al_2O_3$ |
| TiN—TiCN(MT)—TiCN—$Al_2O_3$ | AlON/$ZrO_2$/ZrON | ZrN, ZrCN, TiN or $Al_2O_3$ |
| TiN—TiCN(MT)—TiCN—$Al_2O_3$ | AlON/$Al_2O_3$/$ZrO_2$/ZrON | ZrN, ZrCN, TiN or $Al_2O_3$ |
| TiN | AlON/$ZrO_2$/ZrON/$Zr_2$SN | ZrN, ZrCN, TiN or $Al_2O_3$ |
| TiN | AlON/$Al_2O_3$/$ZrO_2$/ZrON/$Zr_2$SN | ZrN, ZrCN, TiN or $Al_2O_3$ |
| TiN—TiCN(MT) | AlON/$ZrO_2$/ZrON/$Zr_2$SN | ZrN, ZrCN, TiN or $Al_2O_3$ |
| TiN—TiCN(MT) | AlON/$Al_2O_3$/$ZrO_2$/ZrON/$Zr_2$SN | ZrN, ZrCN, TiN or $Al_2O_3$ |
| TiN—TiCN(MT)—$Al_2O_3$ | AlON/$ZrO_2$/ZrON/$Zr_2$SN | ZrN, ZrCN, TiN or $Al_2O_3$ |
| TiN—TiCN(MT)—$Al_2O_3$ | AlON/$Al_2O_3$/$ZrO_2$/ZrON/$Zr_2$SN | ZrN, ZrCN, TiN or $Al_2O_3$ |
| TiN—TiCN(MT)—TiCN—$Al_2O_3$ | AlON/$ZrO_2$/ZrON/$Zr_2$SN | ZrN, ZrCN, TiN or $Al_2O_3$ |
| TiN—TiCN(MT)—TiCN—$Al_2O_3$ | AlON/$Al_2O_3$/$ZrO_2$/ZrON/$Zr_2$SN | ZrN, ZrCN, TiN or $Al_2O_3$ |
| TiN | AlON/$ZrO_2$/ZrON/AlZrO | ZrN, ZrCN, TiN or $Al_2O_3$ |
| TiN | AlON/$Al_2O_3$/$ZrO_2$/ZrON/AlZrO | ZrN, ZrCN, TiN or $Al_2O_3$ |
| TiN—TiCN(MT) | AlON/$ZrO_2$/ZrON/AlZrO | ZrN, ZrCN, TiN or $Al_2O_3$ |
| TiN—TiCN(MT) | AlON/$Al_2O_3$/$ZrO_2$/ZrON/AlZrO | ZrN, ZrCN, TiN or $Al_2O_3$ |
| TiN—TiCN(MT)—$Al_2O_3$ | AlON/$ZrO_2$/ZrON/AlZrO | ZrN, ZrCN, TiN or $Al_2O_3$ |
| TiN—TiCN(MT)—$Al_2O_3$ | AlON/$Al_2O_3$/$ZrO_2$/ZrON/AlZrO | ZrN, ZrCN, TiN or $Al_2O_3$ |
| TiN—TiCN(MT)—TiCN—$Al_2O_3$ | AlON/$ZrO_2$/ZrON/AlZrO | ZrN, ZrCN, TiN or $Al_2O_3$ |
| TiN—TiCN(MT)—TiCN—$Al_2O_3$ | AlON/$Al_2O_3$/$ZrO_2$/ZrON/AlZrO | ZrN, ZrCN, TiN or $Al_2O_3$ |
| TiN | AlON/$ZrO_2$/ZrON/$Zr_2$SN/AlZrO | ZrN, ZrCN, TiN or $Al_2O_3$ |
| TiN | AlON/$Al_2O_3$/$ZrO_2$/ZrON/$Zr_2$SN/AlZrO | ZrN, ZrCN, TiN or $Al_2O_3$ |
| TiN—TiCN(MT) | AlON/$ZrO_2$/ZrON/$Zr_2$SN/AlZrO | ZrN, ZrCN, TiN or $Al_2O_3$ |
| TiN—TiCN(MT) | AlON/$Al_2O_3$/$ZrO_2$/ZrON/$Zr_2$SN/AlZrO | ZrN, ZrCN, TiN or $Al_2O_3$ |
| TiN—TiCN(MT)—$Al_2O_3$ | AlON/$ZrO_2$/ZrON/$Zr_2$SN/AlZrO | ZrN, ZrCN, TiN or $Al_2O_3$ |
| TiN—TiCN(MT)—$Al_2O_3$ | AlON/$Al_2O_3$/$ZrO_2$/ZrON/$Zr_2$SN/AlZrO | ZrN, ZrCN, TIN or $Al_2O_3$ |

TABLE VI-continued

| Coating Architectures | | |
|---|---|---|
| Inner Layer(s) | Composite Layer | Outer Layer (optional) |
| TiN—TiCN(MT)—TiCN—$Al_2O_3$ | AlON/$ZrO_2$/ZrON/$Zr_2SN$/AlZrO | ZrN, ZrCN, TiN or $Al_2O_3$ |
| TiN—TiCN(MT)—TiCN—$Al_2O_3$ | AlON/$Al_2O_3$/$ZrO_2$/ZrON/$Zr_2SN$/AlZrO | ZrN, ZrCN, TiN or $Al_2O_3$ |
| TiN | AlON/$ZrO_2$/$Zr_2SN$ | ZrN, ZrCN, TiN or $Al_2O_3$ |
| TiN | AlON/$Al_2O_3$/$ZrO_2$/$Zr_2SN$ | ZrN, ZrCN, TiN or $Al_2O_3$ |
| TiN—TiCN(MT) | AlON/$ZrO_2$/$Zr_2SN$ | ZrN, ZrCN, TiN or $Al_2O_3$ |
| TiN—TiCN(MT) | AlON/$Al_2O_3$/$ZrO_2$/$Zr_2SN$ | ZrN, ZrCN, TiN or $Al_2O_3$ |
| TiN—TiCN(MT)—$Al_2O_3$ | AlON/$ZrO_2$/$Zr_2SN$ | ZrN, ZrCN, TiN or $Al_2O_3$ |
| TiN—TiCN(MT)—$Al_2O_3$ | AlON/$Al_2O_3$/$ZrO_2$/$Zr_2SN$ | ZrN, ZrCN, TiN or $Al_2O_3$ |
| TiN—TiCN(MT)—TiCN—$Al_2O_3$ | AlON/$ZrO_2$/$Zr_2SN$ | ZrN, ZrCN, TiN or $Al_2O_3$ |
| TiN—TiCN(MT)—TiCN—$Al_2O_3$ | AlON/$Al_2O_3$/$ZrO_2$/$Zr_2SN$ | ZrN, ZrCN, TiN or $Al_2O_3$ |
| TiN | AlON/$ZrO_2$/$Zr_2SN$/AlZrO | ZrN, ZrCN, TiN or $Al_2O_3$ |
| TiN | AlON/$Al_2O_3$/$ZrO_2$/$Zr_2SN$/AlZrO | ZrN, ZrCN, TiN or $Al_2O_3$ |
| TiN—TiCN(MT) | AlON/$ZrO_2$/$Zr_2SN$/AlZrO | ZrN, ZrCN, TiN or $Al_2O_3$ |
| TiN—TiCN(MT) | AlON/$Al_2O_3$/$ZrO_2$/$Zr_2SN$/AlZrO | ZrN, ZrCN, TiN or $Al_2O_3$ |
| TiN—TiCN(MT)—$Al_2O_3$ | AlON/$ZrO_2$/$Zr_2SN$/AlZrO | ZrN, ZrCN, TiN or $Al_2O_3$ |
| TiN—TiCN(MT)—$Al_2O_3$ | AlON/$Al_2O_3$/$ZrO_2$/$Zr_2SN$/AlZrO | ZrN, ZrCN, TiN or $Al_2O_3$ |
| TiN—TiCN(MT)—TiCN—$Al_2O_3$ | AlON/$ZrO_2$/$Zr_2SN$/AlZrO | ZrN, ZrCN, TiN or $Al_2O_3$ |
| TiN—TiCN(MT)—TiCN—$Al_2O_3$ | AlON/$Al_2O_3$/$ZrO_2$/$Zr_2SN$/AlZrO | ZrN, ZrCN, TiN or $Al_2O_3$ |

*MT = Medium Temperature CVD

In some embodiments wherein a coating described herein comprises alumina in an inner layer and/or outer layer, the alumina can be alpha-alumina, kappa-alumina or mixtures of alpha and kappa-alumina.

Additionally, a coating comprising a composite layer described herein can demonstrate a critical load ($L_c$) of at least 60 N. $L_c$ values for coatings described herein were determined according to ASTM C1624-05—Standard Test for Adhesion Strength by Quantitative Single Point Scratch Testing wherein a progressive loading of 10 N was used. In some embodiments, a coating described herein can demonstrate a $L_c$ selected from Table VII.

TABLE VII

| $L_c$ values (N) for CVD coatings |
|---|
| ≥70 |
| ≥80 |
| ≥90 |
| 60-90 |
| 70-80 |

Further, coatings described herein can demonstrate low residual tensile stress or low to moderate residual compressive stress in the as-deposited state. Post coat blasting and/or polishing, in some embodiments, can increase residual compressive stresses of the coating. Post coat blasting can be administered in any desired manner. In some embodiments, post coat blasting comprises shot blasting or pressure blasting. Pressure blasting can be administered in a variety of forms including compressed air blasting, wet compressed air blasting, pressurized liquid blasting, wet blasting, pressurized liquid blasting and steam blasting.

In one embodiment, for example, post coat treatment of a coating described herein can be administered by dry blasting the coating with alumina and/or ceramic particles. Alternatively, the coating can be wet blasted using a slurry of alumina and/or ceramic particles in water at a concentration of 5 volume percent to 35 volume percent. Alumina and/or ceramic particles of post-coat blasting techniques described herein can have a size distribution of 60 μm to 120 μm. Additionally, blasting pressures can range from 2 bar to 3 bar for a time period of 1 to 15 seconds, wherein the blast nozzle is 2 to 8 inches from the coating surface being blasted. Further, angle of impingement of the alumina and/or ceramic particles can be chosen to range from 45 degrees to 90 degrees.

Post coat blasting can also be administered on coated cutting tools described herein in accordance with the disclosure of U.S. Pat. No. 6,869,334 which is incorporated herein by reference in its entirety.

Moreover, polishing can be administered with paste of appropriate diamond or ceramic grit size. Grit size of the paste, in some embodiments, ranges from 1 μm to 10 μm. In one embodiment, a 5-10 μm diamond grit paste is used to polish the coating. Further, grit paste can be applied to the CVD coating by any apparatus not inconsistent with the objectives of the present invention, such as brushes. In one embodiment, for example, a flat brush is used to apply grit paste to the CVD coating. A polished coating described herein, in some embodiments, has a surface roughness ($R_a$) less than 1 μm. In some embodiments, a polished coating has a surface roughness selected from Table VIII.

TABLE VIII

| Polished Coating Surface Roughness ($R_a$)<br>Polished Coating Surface Roughness ($R_a$) - nm |
|---|
| ≤750 |
| ≤500 |
| <200 |
| 100-800 |
| 50-500 |
| 25-150 |

Coating surface roughness can be determined by optical profilometry using WYKO® NT-Series Optical Profilers commercially available from Veeco Instruments, Inc. of Plainview, N.Y., Coatings described herein can demonstrate surface morphologies and structures consistent with being polished, such as striations and/or directionally dependent polishing lines.

II. Methods of Making Coated Cutting Tools

In another aspect, methods of making coated cutting tools are described herein. A method of making a coated cutting tool comprises providing a substrate and depositing over the substrate by chemical vapor deposition at least one composite layer of a coating, the composite layer comprising an aluminum oxynitride phase, a metal oxide phase including zirconium oxide and a metal oxynitride phase in addition to the aluminum oxynitride phase, the metal oxynitride phase comprising zirconium oxynitride. As described herein, the deposited composite layer can further comprise a zirconium sulfur nitride phase. Additionally, the metal oxide phase of the deposited composite layer can further comprise a metallic element selected from the group consisting of aluminum, hafnium and titanium. When present the metallic element can form additional metal oxide and/or a mixed oxide with zirconium. For example, when the metallic element is aluminum, the metal oxide phase can comprise $Al_2O_3$ and/or AlZrO in addition to zirconium oxide.

The composite layer, in some embodiments, is deposited from a gaseous mixture comprising an aluminum source, oxygen source, nitrogen source and zirconium source. The gaseous deposition mixture can also comprise a sulfur source.

Turning now to specific steps, a method described herein comprises providing a substrate. A substrate can comprise any substrate recited in Section I hereinabove. In some embodiments, for example, a substrate is cemented carbide, such as cemented tungsten carbide described in Section I herein. Moreover, a composite layer deposited according to methods described herein can have any construction, compositional parameters and/or properties described in Section I herein for a composite layer, including a construction selected from Table VI herein. In some embodiments, for example, a composite layer comprises an A1ON matrix phase in which metal oxide, metal oxynitride and zirconium sulfide phases are dispersed.

In a method described herein, a composite layer can be deposited from a gaseous mixture comprising an aluminum source, oxygen source, nitrogen source, zirconium source and sulfur source. In some embodiments, for example, an aluminum source comprises $AlCl_3$, an oxygen source comprises $CO_2$, a nitrogen source comprises $NH_3$, a zirconium source comprises $ZrCl_4$ and a sulfur source comprises $H_2S$. Compositional percentages of phases of the composite layer as set forth in Tables I-IV herein can be achieved by varying amounts of individual reactant gases in the mixture. Additionally, the compositional percentages of aluminum, nitrogen and oxygen of the AlON phase as set forth in Section I hereinabove can be achieved by varying amounts of individual reactant gases in the mixture. General CVD processing parameters for depositing a composite layer of a coating described herein are provided in Table IX.

TABLE IX

| Composite Layer General CVD Processing Parameters<br>Ranges of Processing Parameters for Composite Layer | |
|---|---|
| Temperature | 900-1000° C. |
| Pressure | 50-100 mbar |

TABLE IX-continued

| Composite Layer General CVD Processing Parameters<br>Ranges of Processing Parameters for Composite Layer | |
|---|---|
| Time | 400-850 min. |
| $H_2$ | Balance |
| $N_2$ | 30-80 vol. % |
| $AlCl_3$ | 1-6 vol. % |
| $ZrCl_4$ | 0.5-3 vol. % |
| $NH_3$ | 1-4 vol. % |
| $CO_2$ | 1-5 vol. % |
| HCl | 2-6 vol. % |
| $H_2S$ | 0.05-5 vol. % |

In another aspect, a method of making a coated cutting tool comprises providing a substrate and depositing over the substrate by chemical vapor deposition at least one composite layer of a coating, the composite layer comprising an aluminum oxynitride phase, a metal oxide phase including zirconium oxide and a zirconium sulfur nitride phase. The composite layer, in some embodiments, is deposited from a gaseous mixture comprising an aluminum source, oxygen source, nitrogen source, zirconium source and sulfur source. Further, the deposited composite layer can have any structure and/or properties described in Section I herein for a composite layer.

A composite layer, in some embodiments, is deposited directly on a surface of the substrate. Alternatively, a composite layer is deposited on an inner layer of the coating. An inner layer of the coating can have any construction, compositional parameters and/or properties recited in Section I hereinabove for an inner layer. An inner layer, for example, can comprise one or more metallic elements selected from the group consisting of aluminum and one or more metallic elements of Groups IVB, VB, and VIB of the Periodic Table and one or more non-metallic elements selected from the group consisting of non-metallic elements of Groups IIIA, IVA, VA and VIA of the Periodic Table. In some embodiments, an inner layer is a carbide, nitride, carbonitride, oxide or boride of one or more metallic elements selected from the group consisting of aluminum and metallic elements of Groups IVB, VB and VIB of the Periodic Table. An inner over which a composite layer is deposited, for example, can be selected from the group consisting of titanium nitride, titanium carbide, titanium carbonitride, titanium carbonitride, titanium oxycarbonitride, titanium oxide, zirconium oxide, zirconium nitride, zirconium carbonitride, hafnium nitride, hafnium carbonitride and alumina and mixtures thereof.

As with the composite layer, inner layer(s) of a coating described herein can be deposited by CVD. In some embodiments, an inner layer of the coating, such as a TiCN layer, is deposited by medium-temperature (MT) CVD. General CVD deposition parameters for various inner layers are provided in Table X.

TABLE X

General CVD Parameters for inner layer deposition

| Inner Layer Composition | Gas Mixture | Temperature (° C.) | Pressure (mbar) | Duration (minutes) |
|---|---|---|---|---|
| TiN | $H_2$, $N_2$, $TiCl_4$ | 900-930 | 50-200 | 20-60 |
| TiCN(MT) | $H_2$, $N_2$, $TiCl_4$, $CH_3CN$ | 750-900 | 50-100 | 300-500 |
| TiCN(HT) | $H_2$, $N_2$, $TiCl_4$, $CH_4$ | 900-1050 | 30-500 | 10-100 |
| TiOCN | $H_2$, $N_2$, $TiCl_4$, $CH_4$, CO | 900-1050 | 60-500 | 30-100 |
| $Al_2O_3$ | $H_2$, $N_2$, $CO_2$, HCl, CO, $AlCl_3$ | 900-1050 | 50-100 | 50-250 |

Further, methods described herein can also comprise depositing over the composite layer one or more outer layers. Outer layer(s) of a coating described herein, in some embodiments, are deposited by CVD. An outer layer of the coating can have any construction, compositional parameters and/or properties recited in Section I hereinabove for an outer layer. An outer layer can comprise one or more metallic elements selected from the group consisting of aluminum and metallic elements of Groups IVB, VB and VIB of the Periodic Table and one or more non-metallic elements selected from the group consisting of non-metallic elements of Groups IIIA, IVA, VA and VIA of the Periodic Table, In some embodiments, one or more outer layers over the composite layer comprise a nitride, carbonitride, oxycarbonitride, oxide or boride of one or more metallic elements selected from the group consisting of aluminum and metallic elements of Groups IVB, VB and VIB of the Periodic Table. For example, one or more outer layers are selected from the group consisting of titanium nitride, titanium carbonitride, titanium carbide, zirconium nitride, zirconium carbonitride, hafnium nitride, hafnium carbonitride and alumina and mixtures thereof.

Additionally, methods of making coated cutting tools described herein can further comprise post coat blasting and/or polishing the deposited coating. Post coat blasting can be administered in any desired manner, including dry blasting and wet blasting techniques. In some embodiments, post coat blasting is administered in a manner described in Section I hereinabove. Post coat blasting can change moderate tensile stress of the coating to moderate compressive stress or increase compressive stress in the as-deposited coating. Polishing can also be administered in any desired manner, including the polishing techniques described in Section I herein.

These and other embodiments are further illustrated in the following non-limiting examples.

EXAMPLE 1

Coated Cutting Tool Body

A coated cutting tool described herein was produced by placing a cemented tungsten carbide (WC—Co) cutting insert substrate [ANSI standard geometry CNMG432RN] into an axial flow hot-wall CVD reactor. The cutting insert comprised about 6 wt.% cobalt binder with the balance WC grains of size 1 to 5 μm. A coating having an architecture provided in Table XIII was deposited on the cemented WC insert according to the CVD process parameters provided in Tables XI and XII.

TABLE XI

CVD Deposition of Coating

| Process Step | $H_2$ vol. % | $N_2$ vol. % | $TiCl_4$ vol. % | $CH_3CN$ vol. % | $CH_4$ vol. % | $AlCl_3$ vol. % | $CO_2$ vol. % | $ZrCl_4$ vol. % | $NH_3$ vol. % | HCl vol. % | $H_2S$ vol. % |
|---|---|---|---|---|---|---|---|---|---|---|---|
| TiN | Bal. | 30-40 | 0.5-3 | 0 | 0 | 0 | 0 | 0 | 0 | 0 | 0 |
| MT-TiCN | Bal. | 10-40 | 0.5-3 | 0.05-1 | 0 | 0 | 0 | 0 | 0 | 0 | 0 |
| TiCN | Bal. | 10-45 | 1-2 | 0 | 2-4 | 0 | 0 | 0 | 0 | 0 | 0 |
| $Al_2O_3$ | Bal. | 0-10 | 0 | 0 | 0 | 4-7 | 1-4 | 0 | 0 | 1-3 | 0-1 |
| $AlON/Al_2O_3/ZrO_2/ZrON/Zr_2SN$* | Bal. | 40-70 | 0 | 0 | 0 | 3-6 | 1-4 | 0.5-3 | 0.5-2 | 2-5 | 0.05-1 |

*Composite Layer

TABLE XII

CVD Deposition of Coating

| Process Step | Temp. ° C. | Pressure mbar | Time min. |
|---|---|---|---|
| TiN | 900-930 | 150-200 | 30-40 |
| MT-TiCN | 860-900 | 70-100 | 380-420 |
| TiCN | 980-1000 | 450-500 | 10-80 |
| $Al_2O_3$ | 980-1000 | 70-90 | 170-210 |
| $AlON/Al_2O_3/ZrO_2/ZrON/Zr_2SN$* | 980-1000 | 70-90 | 500-700 |

*Composite Layer

Figure 3:
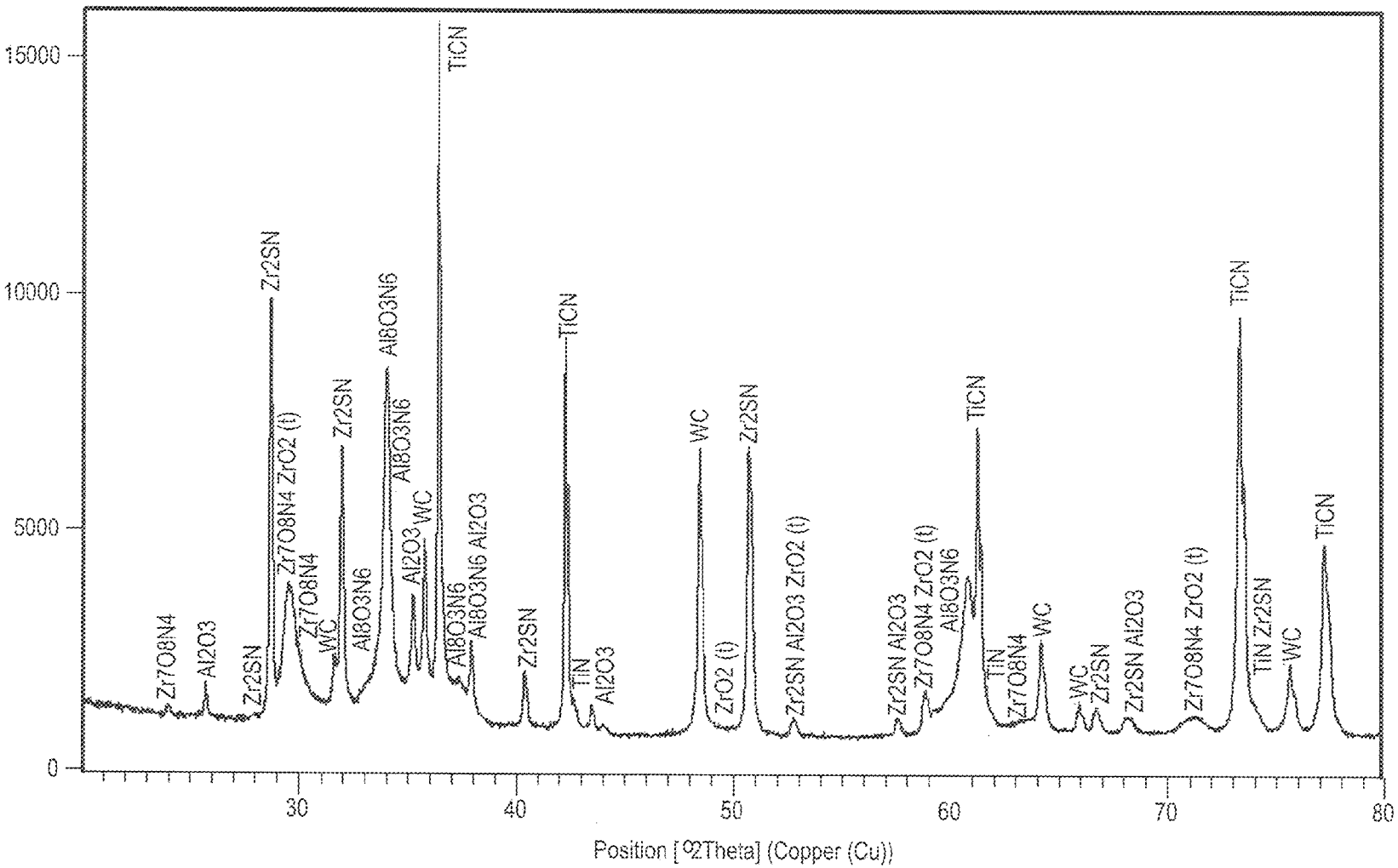
FIG. 3 is an XRD spectrum of a coated cutting insert according to one embodiment described herein.

The resulting multilayered coating comprising an $AlON/Al_2O_3/ZrO_2/ZrON/Zr_2SN$ composite layer demonstrated the structure provided in Table XIII. FIG. 3 is an XRD spectrum of the coated cutting insert.

TABLE XIII

Properties of CVD Coating

| Coating Layer | Thickness (μm) |
|---|---|
| TiN | 0.6 |
| MT-TiCN | 9.0 |
| TiCN | 1.3 |
| $Al_2O_3$ | 2.2 |
| $AlON/Al_2O_3/ZrO_2/ZrON/Zr_2SN$ | 4.0 |

Figure 2:
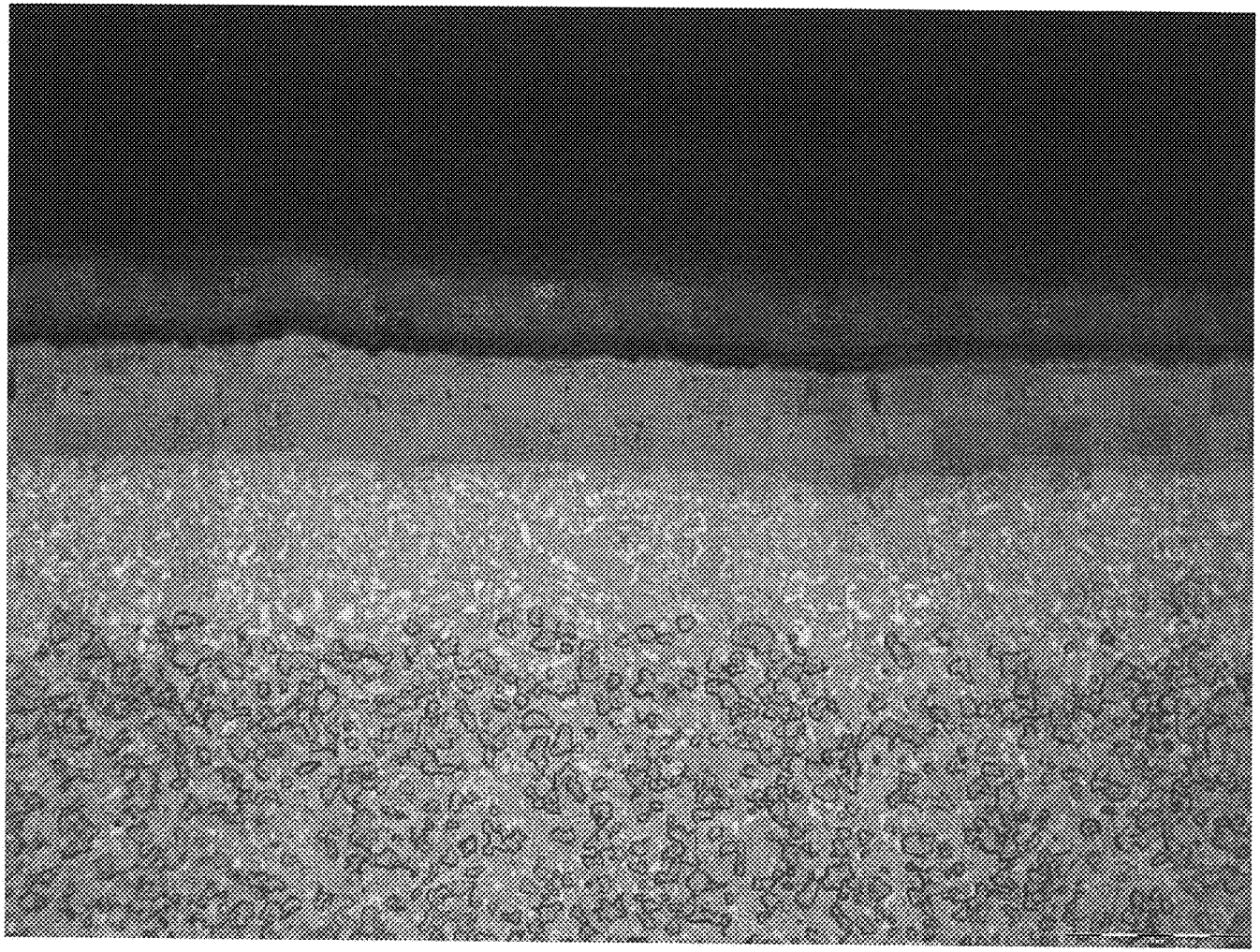
FIG. 2 is a cross-sectional optical image of a coated cutting insert according to one embodiment described herein.

FIG. 2 is a cross-sectional photomicrograph of the coated cutting insert of this Example demonstrating layers of the coating architecture. The coating demonstrated a $L_c$ of greater than 70 N according to ASTM C1624-05—Standard Test for Adhesion Strength by Quantitative Single Point Scratch Testing wherein a progressive loading of 10 N was used.

EXAMPLE 2

Continuous Turning Testing

For continuous turning testing, coated cutting inserts A and B were produced in accordance with the procedure set forth in Example 1 and demonstrated the coating structure of Example 1, Further, coated cutting insert A was subjected to a post-coat treatment of wet blasting with alumina particle slurry, and coated cutting insert B was subjected to a post-coat treatment of polishing with 5-10 μm diamond grit paste. Insert A was blasted in such a way as to smoothen the surface of the insert in its entirety. This method may also be used to remove a sacrificial top layer entirely from the rake and flank surfaces, Insert B was polished for 30 seconds in such a way as to polish the edge along the flank and rake at a length approximately twice the length of the hone radius away from the edge.

Comparative cutting insert C was also provided for continuous turning testing with coated cutting inserts A and B. Comparative cutting insert C employed the same WC substrate as cutting inserts A and B and included a CVD coating having the parameters set forth in Table XIV. TiN was the coating layer adjacent to the WC substrate of Comparative cutting insert C.

TABLE XIV

CVD Coating of Comparative Insert C

| Coating Layer | Thickness (μm) |
|---|---|
| TiN | 0.5 |
| MT-TiCN | 8.2 |
| TiCN/TiOCN | 1.1 |
| $Al_2O_3$ | 6.8 |
| TiCN/TiN | 1.5 |

For the continuous turning testing, two cutting edges for each coated insert of A, B and comparative C were tested. Coated inserts A, B and comparative C were subjected to continuous turning testing as follows:

Workpiece—1045 Steel
Speed—1000 sfm (304.8 m/min)
Feed Rate—0.012 ipr (0.3048 mm/min)
Depth of Cut—0.08 inch (0.08 mm)
Lead Angle: −5°
Coolant—Flood
End of Life was Registered by One or More Failure Modes of:
Uniform Wear (UW) of 0.012 inches
Max Wear (MW) of 0.012 inches
Nose Wear (NW) of 0.012 inches
Depth of Cut Notch Wear (DOCN) 0f 0.012 inches
Trailing Edge Wear (TW) of 0.012 inches
Crater Wear (CW) of 0.004 inches The results of the continuous turning testing are provided in Table XV.

TABLE XV

Continuous Turning Testing Results

| Cutting Insert | Repetition 1 Lifetime (minutes) | Repetition 2 Lifetime (minutes) | Mean Cutting Lifetime (minutes) |
|---|---|---|---|
| A | 13.0 | 12.7 | 12.9 |
| B | 14.7 | 14.5 | 14.6 |
| C | 9.9 | 10.4 | 10.2 |

As provided in Table XV, coated cutting inserts A and B having architectures described herein demonstrated superior cutting lifetimes relative to comparative insert C. Coated cutting insert A displayed a 127% lifetime relative to comparative insert C, and coated cutting insert B displayed a 144% lifetime relative to comparative insert C.

EXAMPLE 3

Interrupted Turning Test

For interrupted turning tests, coated inserts A and B were produced in accordance with the procedures set forth in Example 1 and prepared by the post-coat treatment described in Example 2. A comparative cutting insert C was also provided with inserts A and B. Comparative insert C employed the same WC substrate as inserts A and B and included a CVD coating of Table XIV in Example 2. For the interrupted turning testing, two cutting edges for each coated insert of A, B and comparative C were tested. Coated inserts A, B and comparative C were subjected to interrupted turning testing as follows:

Workpiece—4140 Steel
Workpiece shape—round with 4 1" slots parallel to length of bar
Speed—500 sfm (152 m/min)
Feed Rate—0.012 ipr (0.3048 mm/min)
Depth of Cut—0.1inch (0.1 mm)
Lead Angle: −5°
Coolant—Flood
End of Life was Registered by One or More Failure Modes of:
Uniform Wear (UW) of 0.012 inches
Max Wear (MW) of 0.012 inches
Nose Wear (NW) of 0.012 inches
Depth of Cut Notch Wear (DOCN) 0f 0.012 inches
Trailing Edge Wear (TW) of 0.012 inches
Crater Wear (CW) of 0.004 inches The results of the continuous turning testing are provided in Table XVI.

TABLE XVI

Continuous Turning Testing Results

| Cutting Insert | Repetition 1 Lifetime (minutes) |
|---|---|
| A | 8.3 |
| B | 6.2 |
| C | 6.3 |

As demonstrated in Table XVI, coated insert A had a longer tool live and had higher resistance to chipping and flaking relative to comparative insert C. Comparative insert C suffered critical failure with breakage of the cutting edge. At the same time, cutting insert A remained intact with a continuous coating on the cutting edge.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. A coated cutting tool comprising:

a substrate; and a coating adhered to the substrate, the coating comprising at least one composite layer deposited by chemical vapor deposition, the composite layer comprising an aluminum oxynitride phase, a metal oxide phase including zirconium oxide and a metal oxynitride phase in addition to the aluminum oxynitride phase, the metal oxynitride phase comprising zirconium oxynitride.

2. The coated cutting tool of claim 1, wherein the composite layer further comprises a zirconium sulfur nitride phase.

3. The coated cutting tool of claim 1, wherein the aluminum oxynitride phase comprises hexagonal crystalline structure, cubic crystalline structure or amorphous crystalline structure or mixtures thereof.

4. The coated cutting tool of claim 1, wherein the aluminum oxynitride phase comprises aluminum in an amount of 20 to 50 atomic percent, nitrogen in an amount of 40 to 70 atomic percent and oxygen in an amount of 1 to 20 atomic percent.

5. The coated cutting tool of claim 1, wherein the zirconium oxide is dispersed in the aluminum oxynitride phase.

6. The coated cutting tool of claim 5, wherein the zirconium oxynitride is dispersed in the aluminum oxynitride phase.

7. The coated cutting tool of claim 1, wherein the metal oxide phase further comprises a metallic element selected the group consisting of aluminum, hafnium and titanium.

8. The coated cutting tool of claim 7, wherein the metallic element forms a metal oxide in addition to the zirconium oxide.

9. The coated cutting tool of claim 8, wherein the metallic element is aluminum and the metal oxide is $Al_2O_3$.

10. The coated cutting tool of claim 7, wherein the metallic element forms a mixed oxide with zirconium.

11. The coated cutting tool of claim 10, wherein the metallic element is aluminum and the mixed oxide is AlZrO.

12. The coated cutting tool of claim 1, wherein the metal oxynitride phase further comprises an oxynitride of a metallic element selected from Group IVB, VB or VIB of the Periodic Table.

13. The coated cutting tool of claim 1, wherein the coating adhered to the substrate has a critical load ($L_c$) of at least 60 N.

14. The coated cutting tool of claim 2, wherein the composite layer is of a color having a wavelength in the range of 490 nm to 580 nm.

15. The coated cutting tool of claim 1, wherein the coating further comprises one or more inner layers between the composite layer and the substrate.

16. The coated cutting tool of claim 15, wherein the one or more inner layers comprise one or more metallic elements selected from the group consisting of aluminum and metallic elements of Groups IVB, VB and VIB of the Periodic Table and one or more non-metallic elements selected from the group consisting of non-metallic elements of Groups IIIA, IVA, VA and VIA of the Periodic Table.

17. The coated cutting tool of claim 15, wherein the one or more inner layers comprise a carbide, nitride, carbonitride, oxide or boride of a metallic element selected from the group consisting of aluminum and metallic elements of Groups IVB, VB and VIB of the Periodic Table.

18. The coated cutting tool of claim 1, wherein the coating further comprises one or more outer layers over the composite layer.

19. The coated cutting tool of claim 18, wherein the one or more outer layers comprise one or more metallic elements selected from the group consisting of aluminum and metallic elements of Groups IVB, VB and VIB of the Periodic Table and one or more non-metallic elements selected from the group consisting of non-metallic elements of Groups IIIA, IVA, VA and VIA of the Periodic Table.

20. The coated cutting tool of claim 1, wherein the substrate is cemented carbide, cermet or ceramic based on $Si_3N_4$, $Al_2O_3$ or $ZrO_2$ or mixtures thereof.

21. A coated cutting tool comprising:

a substrate; and a coating adhered to the substrate, the coating comprising at least one composite layer deposited by chemical vapor deposition, the composite layer comprising an aluminum oxynitride phase, a metal oxide phase including zirconium oxide and a zirconium sulfur nitride phase.

22. The coated cutting tool of claim 21, wherein the aluminum oxynitride phase comprises hexagonal crystalline structure, cubic crystalline structure or amorphous crystalline structure or mixtures thereof.

23. The coated cutting tool of claim 21, wherein the aluminum oxynitride phase comprises aluminum in an amount of 20 to 50 atomic percent, nitrogen in an amount of 40 to 70 atomic percent and oxygen in an amount of 1 to 20 atomic percent.

24. The coated cutting tool of claim 21, wherein the zirconium sulfur nitride phase is disperses in the aluminum oxynitride phase.

25. The coated cutting tool of claim 21, wherein the metal oxide phase further comprises a metallic element selected the group consisting of aluminum, hafnium and titanium.

26. The coated cutting tool of claim 25, wherein the metallic element forms a metal oxide in addition to the zirconium oxide.

27. The coated cutting tool of claim 26, wherein the metallic element is aluminum and the metal oxide is $Al_2O_3$.

28. The coated cutting tool of claim 25, wherein the metallic element forms a mixed oxide with zirconium

29. The coated cutting tool of claim 28, wherein the metallic element is aluminum and the mixed oxide is AlZrO.

30. The coated cutting tool of claim 21, wherein the coating adhered to the substrate has a critical load ($L_c$) of at least 60 N.

31. The coated cutting tool of claim 21, wherein the composite layer is of a color having a wavelength in the range of 490 nm to 580 nm.

32. The coated cutting tool of claim 21, wherein the coating further comprises one or more inner layers between the composite layer and the substrate.

33. The coated cutting tool of claim 32, wherein the one or more inner layers comprise one or more metallic elements selected from the group consisting of aluminum and metallic elements of Groups IVB, VB and VIB of the Periodic Table and one or more non-metallic elements selected from the group consisting of non-metallic elements of Groups IIIA, IVA, VA and VIA of the Periodic Table.

34. The coated cutting tool of claim 21, wherein the coating further comprises one or more outer layers over the composite layer.

35. The coated cutting tool of claim 21, wherein the substrate is cemented carbide, cermet or ceramic based on $Si_3N_4$, $Al_2O_3$ or $ZrO_2$ or mixtures thereof.

* * * * *